US009371203B2

(12) United States Patent
Go et al.

(10) Patent No.: US 9,371,203 B2
(45) Date of Patent: Jun. 21, 2016

(54) CASH CASSETTE COMPRISING A PRESS-ON UNIT HAVING AN ELASTIC SNAP-IN ELEMENT

(71) Applicants: Wincor Nixdorf Pte Ltd, Singapore (SG); Wincor Nixdorf International GmbH, Paderborn (DE)

(72) Inventors: Florante Go, Singapore (SG); Elmar Berendes, Warburg (DE); Hengky Wirawan, Singapore (SG); Joerg Plotzitzka, Rietberg (SG)

(73) Assignees: Wincor Nixdorf Pte Ltd., Singapore (SG); Wincor Nixdorf International GmbH (DE)

( * ) Notice: Subject to any disclaimer, the term of this patent is extended or adjusted under 35 U.S.C. 154(b) by 0 days.

(21) Appl. No.: 14/643,157

(22) Filed: Mar. 10, 2015

(65) Prior Publication Data

US 2015/0251861 A1 Sep. 10, 2015

(30) Foreign Application Priority Data

Mar. 10, 2014 (EP) ..... 14158550

(51) Int. Cl.
*B65H 1/02* (2006.01)
*G07D 11/00* (2006.01)

(52) U.S. Cl.
CPC ..... *B65H 1/022* (2013.01); *B65H 1/027* (2013.01); *G07D 11/0006* (2013.01); *G07D 11/0012* (2013.01)

(58) Field of Classification Search
CPC .... B65H 1/02; B65H 1/022; B65H 2405/211; B65H 2405/2111; B65H 3/0653; G07D 11/0006; G07D 11/0012
USPC ..... 271/149, 3.12, 171
See application file for complete search history.

(56) References Cited

U.S. PATENT DOCUMENTS 4,275,667 A 6/1981 Hilton
5,931,456 A * 8/1999 Laidlaw ..... 271/171

(Continued)

FOREIGN PATENT DOCUMENTS

DE 2949344 A1 6/1980
DE 102008044838 A1 3/2010

(Continued)

OTHER PUBLICATIONS

International Search Report (in English and German) for PCT/EP2013/068791, mailed Feb. 17, 2014; ISA/EP.

(Continued)

*Primary Examiner* — Michael McCullough
(74) *Attorney, Agent, or Firm* — Harness, Dickey & Pierce, P.L.C.

(57) ABSTRACT

The invention relates to a cash cassette (10) having a receiving compartment (20) for receiving a value note stack (60) and a press-on unit (24) for exerting a counterforce directed opposite to the direction of deposit (P1) on the value note stack (60) received in the receiving compartment (20). A bottom unit (22) has at least a first snap-in element (42) and the press-on unit (24) has a second snap-in element (40) via which a snap-fit connection can be established. The second snap-in element (40) is elastically formed such that the press-on unit (24) is movable further in the direction of deposit (P1) by a predetermined distance even when the snap-fit connection is established.

14 Claims, 8 Drawing Sheets

(56) References Cited

U.S. PATENT DOCUMENTS

| | | | | |
|---|---|---|---|---|
| 7,950,653 | B2 | 5/2011 | Berendes | |
| 8,500,000 | B2 | 8/2013 | Berendes | |
| 8,555,792 | B2 | 10/2013 | Berendes | |
| 8,567,773 | B2 | 10/2013 | Berendes | |
| 8,640,913 | B2 | 2/2014 | Berendes | |
| 8,887,986 | B2 | 11/2014 | Berendes | |
| 8,935,884 | B2 | 1/2015 | Pang et al. | |
| 2011/0155736 | A1 | 6/2011 | Berendes | |
| 2013/0026178 | A1* | 1/2013 | Peters et al. | 221/279 |
| 2013/0100014 | A1 | 4/2013 | Rabanos et al. | |
| 2013/0152475 | A1 | 6/2013 | Pang et al. | |
| 2014/0299658 | A1 | 10/2014 | Houben et al. | |
| 2014/0368102 | A1 | 12/2014 | Go | |
| 2015/0027354 | A1 | 1/2015 | Berendes | |

FOREIGN PATENT DOCUMENTS

| | | | |
|---|---|---|---|
| EP | 02 63 680 | A1 | 4/1988 |
| EP | 2551830 | A1 | 1/2013 |
| EP | 2738746 | A1 | 6/2014 |
| EP | 2814006 | A1 | 12/2014 |
| EP | 2814007 | A1 | 12/2014 |
| KR | 102010073472 | | 7/2010 |

OTHER PUBLICATIONS

European Search Report (in German) for priority application EP 12184438.5, dated Feb. 5, 2013.

Extended European Search Report for European Application No. 14158550.5 dated Aug. 13, 2014 (6 pages) in English.

* cited by examiner

CASH CASSETTE COMPRISING A PRESS-ON UNIT HAVING AN ELASTIC SNAP-IN ELEMENT

CROSS-REFERENCE TO RELATED APPLICATIONS

This application claims the benefit and priority of European Patent Application No. EP 14 158 550.5 filed Mar. 10, 2014. The entire disclosure of the above application is incorporated herein by reference.

BACKGROUND

1. Technical Field

The invention relates to a cash cassette having a receiving compartment for receiving a value note stack, the receiving compartment comprising a bottom unit limiting the receiving compartment in the direction of a cassette bottom, and a press-on unit for exerting a counterforce on the value note stack received in the receiving compartment, which counterforce is directed opposite to the direction of deposit of notes of value. Here, the press-on unit is movable in the direction of deposit and opposite to the direction of deposit.

2. Discussion

From the not-yet-published European patent application 13 171 458.6, a cash cassette is known, which comprises a press-on unit for exerting a counterforce for holding a value note stack in the receiving compartment. This press-on unit has a spring which is tensioned the more, the further the press-on unit is away from an opening of the cash cassette, i.e. the more notes of value are received. Further, the press-on unit has a locking element by means of which the press-on unit is lockable in an end position.

A similar cash cassette is known from the likewise not-yet-published European patent application 13 171 459.4.

From the non-yet-published European patent application 12 194 757.6, a cash cassette is known, the press-on unit of which comprises a counterplate which contacts the front end of the received value note stack. This counterplate is spring-mounted together with the housing of the press-on unit so that, even in the case of a fixed press-on unit, the counterplate is movable by a predetermined distance relative to the rest of the press-on unit.

Known press-on units are problematic in that they are relatively hard only movable in the direction of deposit or opposite to the direction of deposit, which may result in problems and value note jams in the case of a sudden displacement of the value note stack during certain processes. At worst, it may result in that the device automatically goes out of service for safety reasons.

For example, the rolls via which the notes of value can be pulled off from the front side of the value note stack have a projecting segment so that they do not have a uniform diameter and thus problems may arise in the case of a stationary value note stack. Further, when a closing unit of the cash cassette is closed, the value note stack is pushed further into the receiving compartment by a retaining element which is then moved from an open position into a retaining position. For this, too, it is required that the value note stack can be moved into the receiving compartment easily, and nevertheless a safe holding of the value note stack in the receiving compartment without turning over is achieved.

Moreover, known press-on units often have the problem that, when the cash cassette is vertically oriented, the force exerted on the press-on unit by the value note stack may be greater than the counterforce so that, in particular in the case of a vertical orientation of the cash cassette, the press-on unit can inadvertently be moved into the direction of deposit which can result in that the notes of value of the value note stack can turn over. This may result in problems when dispensing the notes of value later on.

It is the object of the invention to specify a cash cassette which enables a safe holding of the notes of value in the receiving compartment, yet is still not susceptible to failure.

According to an aspect of the invention, the bottom unit of the cash cassette has at least a first snap-in element and the press-on unit has a second snap-in element that is complementarily formed to the first snap-in element. By the first and the second snap-in element, a snap-fit connection is formed between the bottom unit and the press-on unit, via which snap-fit connection the counterforce required for holding the value note stack in its planned orientation is applied. Thus, it is achieved that by means of a corresponding snap-fit connection, the force exerted by the weight of this value note stack on the press-on unit will not be so high that the press-on unit is inadvertently moved further into the direction of deposit, even in the case of a vertically oriented cash cassette.

The second snap-in element is formed elastically such that the press-on unit is still movable further in the direction of deposit by a predetermined distance when the snap-fit connection between the first and the second snap-in element is established. Thus, it is achieved that a correspondingly little displacement of the value note stack by this distance in the direction of deposit is possible, which is, for example, advantageous when notes of value are automatically removed by means of a feed and/or stacking module. Such feed and/or stacking modules in particular comprise rolls having a projecting segment so that the roll has an actually smaller diameter and a larger diameter due to the projecting segment so that the distance between the axis of rotation of the roll and the contact area via which the note of value to be pulled off is contacted varies. If the value note stack were to be held relatively rigidly in a receiving compartment, this could result in that the value note stack cannot be moved into the receiving compartment sufficiently far enough by the projecting segment, and thus failures can occur. At worst, the separating and/or stacking module would go out of service.

Via the elastic second snap-in element, the value note stack is again moved back opposite to the direction of deposit as soon as the projecting segment of the pull-off roll no longer contacts the value note stack so that the value note stack is held firmly between the pull-off roll and the press-on unit at all times.

In addition, the elastic design of the second snap-in element has the advantage that a retaining element which holds the value note stack in the receiving compartment at the feed opening side of the cash cassette, i.e. the side of the receiving compartment that is arranged opposite to the press-on unit, is pivotable even when the press-on unit is snapped in. Here, this retaining element is pivotable between a retaining position and an open position, wherein, when moved from the open position into the retaining position, it moves the value note stack further into the receiving compartment in the direction of deposit by a predetermined distance.

The predetermined distance, by which the second snap-in element is deformable, is in particular designed such that it comprises at least the distance by which the retaining element, when moved from the open into the retaining position, moves the value note stack so that despite of an existing snap-fit connection a movement of the retaining element from the open into the retaining position is possible.

The cash cassette in particular comprises several first snap-in elements arranged one behind the other as viewed in the direction of deposit, these first snap-in elements preferably being identically formed. By providing several first snap-in elements arranged one behind the other it is achieved that the second snap-in element can snap into another first snap-in element depending on the filling level of the cash cassette, i.e. depending on how many notes of value are received in the receiving compartment, and thus can be adapted to the received amount in a step-by-step manner. In this way, the value note stack can always be held safely in the receiving compartment and a turning over of notes of value is prevented.

The snap-fit connection is in particular designed such that when a limit force is exceeded the snap-fit connection is released so that the second snap-in element separates from the first snap-in element and snaps into the next first snap-in element as viewed in the direction of deposit. This limit force is in particular set such that it is exerted via a feed and/or stacking module when feeding notes of value so that the step-by-step displacement of the press-on unit into the individual first snap-in elements automatically takes place when notes of value are supplied.

As this snapping into the first snap-in elements arranged one behind the other takes place in a step-by-step manner, the elastic design of the second snap-in element is particularly advantageous since in this way a continuous displacement of the press-on unit is likewise possible between the individual steps. Thus, the notes of value are always held safely within the receiving compartment under a minimum pressure.

Further, it is advantageous when the first snap-in element or the first snap-in elements are formed in the bottom unit as a recess into which the second snap-in element can engage. In this way, a particularly simple design is achieved.

The press-on unit in particular comprises a locking element for holding the press-on unit in an end position, the locking element—in a locking position—being engaged with a stationary first engagement element of the cash cassette, and—in the unlocked position—allowing a displacement of the press-on unit opposite to the direction of deposit. The end position is in particular the position which the press-on unit assumes when it is arranged at the end of the receiving compartment that is opposite to the feed opening. The locking element in particular serves to lock the press-on unit in the end position when the cash cassette is manually filled and/or emptied.

The second snap-in element is in particular designed as a part of this locking element so that a particularly simple structure is achieved.

The locking element is in particular mounted on the press-on unit so as to be pivotable about an axis of rotation and is pivotable about this axis of rotation between the locking position and the unlocked position. The locking element is in particular held in the locking position by an elastic element, preferably a spring, and is movable against a restoring force of this elastic element from the locking position into the unlocked position. Thus, it is achieved that the second snap-in element, too, is held in a lower position via this elastic element and is movable into an upper position against the restoring force of this elastic element so that the elastic element can perform a movement together with the locking element, which simplifies the displacement of the snap-in element. The locking element in particular comprises a lever for manual actuation so that the locking element can be moved easily between the locking position and the unlocked position.

In a particularly preferred embodiment, the second snap-in element has a stiff portion for snapping into the first snap-in element, this stiff portion being connected to the press-on unit via a flexible portion. By means of this stiff portion, it is guaranteed that the two snap-in elements safely snap into each other, the flexible portion providing the elastic deformability of the snap-in element.

The second snap-in element is in particular designed such that it acts like a compressible spring.

The flexible portion is in particular formed as a film hinge via which a correspondingly movable connection of the stiff portion with the rest of the press-on unit, in particular, with the locking element is accomplished.

In an alternative embodiment, the snap-in element can, for example, also be connected to the rest of the press-on unit via a spring or another more complex mechanism, in a correspondingly elastically deformable, i.e. compressible manner.

Further, it is advantageous if the snap-in element is elastically formed such that it is movable between a first and a second position against a restoring force of the snap-in element. This movement from the first into the second position in particular takes place automatically in that the value note stack is pushed further into the receiving compartment in the direction of deposit. The force required for this is, for example, applied by a feed module and/or a retaining element. A movement from the second into the first position automatically takes place due to the restoring force of the second snap-in element, as soon as this restoring force is higher than the force that has previously moved the second snap-in element from the first into the second position.

In a preferred embodiment, the predetermined distance by which the press-on unit is still movable in the direction of deposit when the snap-fit connection is established is shorter than the height of the smallest note of value to be received in the receiving compartment. Thus, it is prevented that the note of value can turn over so that the planned deposit of the notes of value standing on their edges is safely maintained.

The first snap-in element is in particular designed such that after establishing the contact between the first and the second snap-in element the second snap-in element can still be moved further in the direction of deposit by a predetermined distance while the second snap-in element is guided in the first snap-in element before then the snap-fit connection is finally established. By the first final establishment is understood that at least the part of the second snap-in element that engages with the first snap-in element no longer moves relative to the first snap-in element. When the snap-fit connection is finally established, the press-on unit can only move further in the direction of deposit by the predetermined distance as a result of the elastic deformation of the second snap-in element before then an end position is reached beyond which the press-on unit can only be moved further if the snap-fit connection between the second snap-in element and the first snap-in element is released.

This total distance resulting from the elastic deformation and the movement of the two snap-in elements into one another is in particular designed smaller than the height of the smallest notes of value to be received in the receiving compartment so that a turning over of these notes of value is prevented. In particular, this total distance has a length between 10 mm and 30 mm, preferably between 17 mm and 22 mm, for example of about 20 mm. As a result of these dimensions, it is on the one hand prevented that the notes of value turn over and on the other hand sufficient movability of the press-on unit is achieved.

The second snap-in element in particular has a foot portion for bearing against and sliding on the first snap-in element. In particular, this foot portion already comes into contact with the first snap-in element when the press-on unit is moved so far in the direction of deposit that the second snap-in element is arranged at the front end of the first snap-in element as viewed in the direction of deposit.

BRIEF DESCRIPTION OF THE DRAWINGS

Further features and advantages of the invention result from the following description which explains the invention in more detail on the basis of embodiments in connection with the enclosed Figures, in which.

DETAILED DESCRIPTION OF THE PREFERRED EMBODIMENTS

Figure 1:
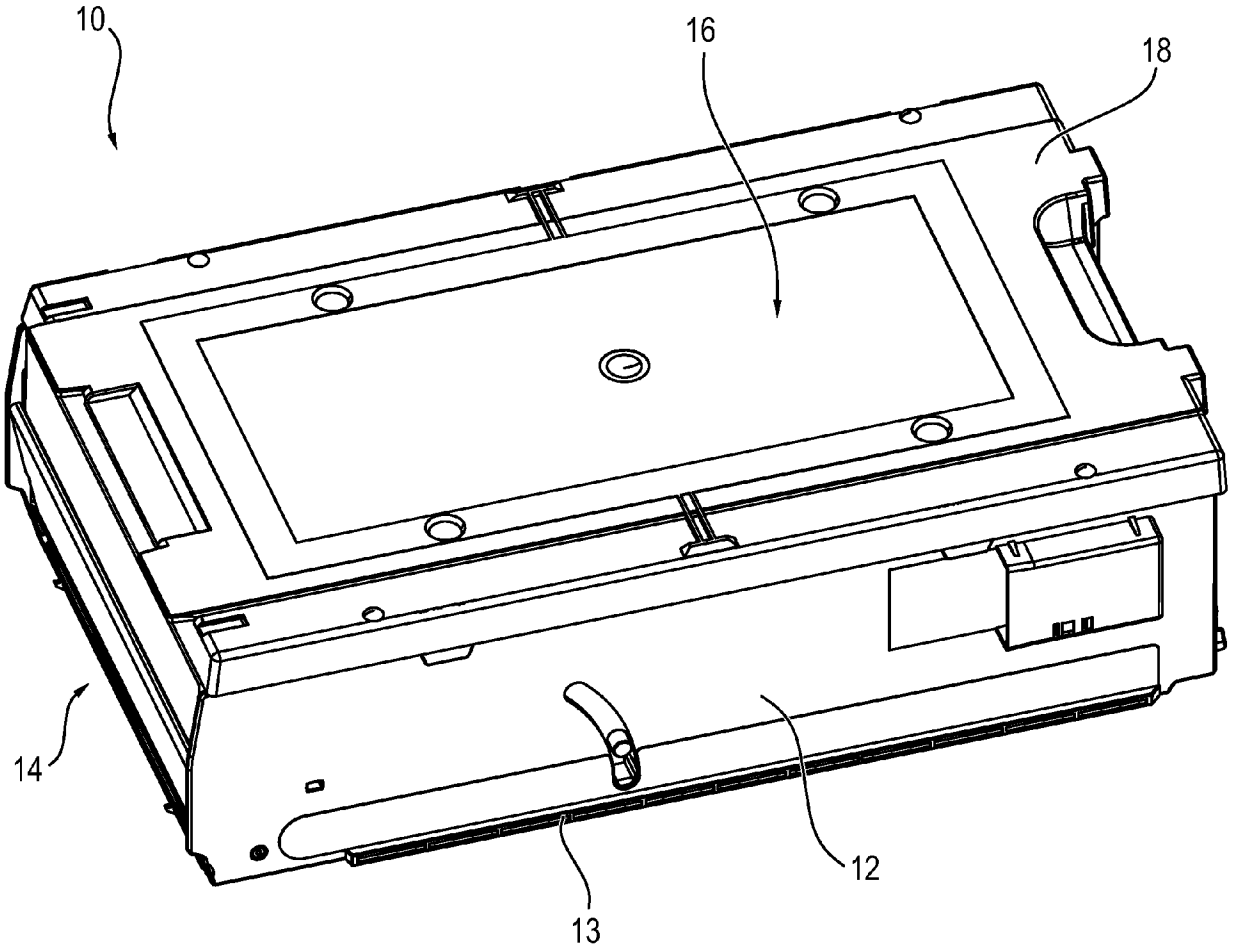
FIG. 1 shows a schematic perspective illustration of a cash cassette.

In FIG. 1, a schematic perspective illustration of a cash cassette 10 is shown, which comprises a housing 12 having a cassette bottom 13. The cash cassette 10 has a first opening 14 for automatically feeding and/or removing notes of value as well as a second opening 16 for manually feeding and/or removing notes of value, which second opening 16 is closable by a cover 18.

Figure 2:
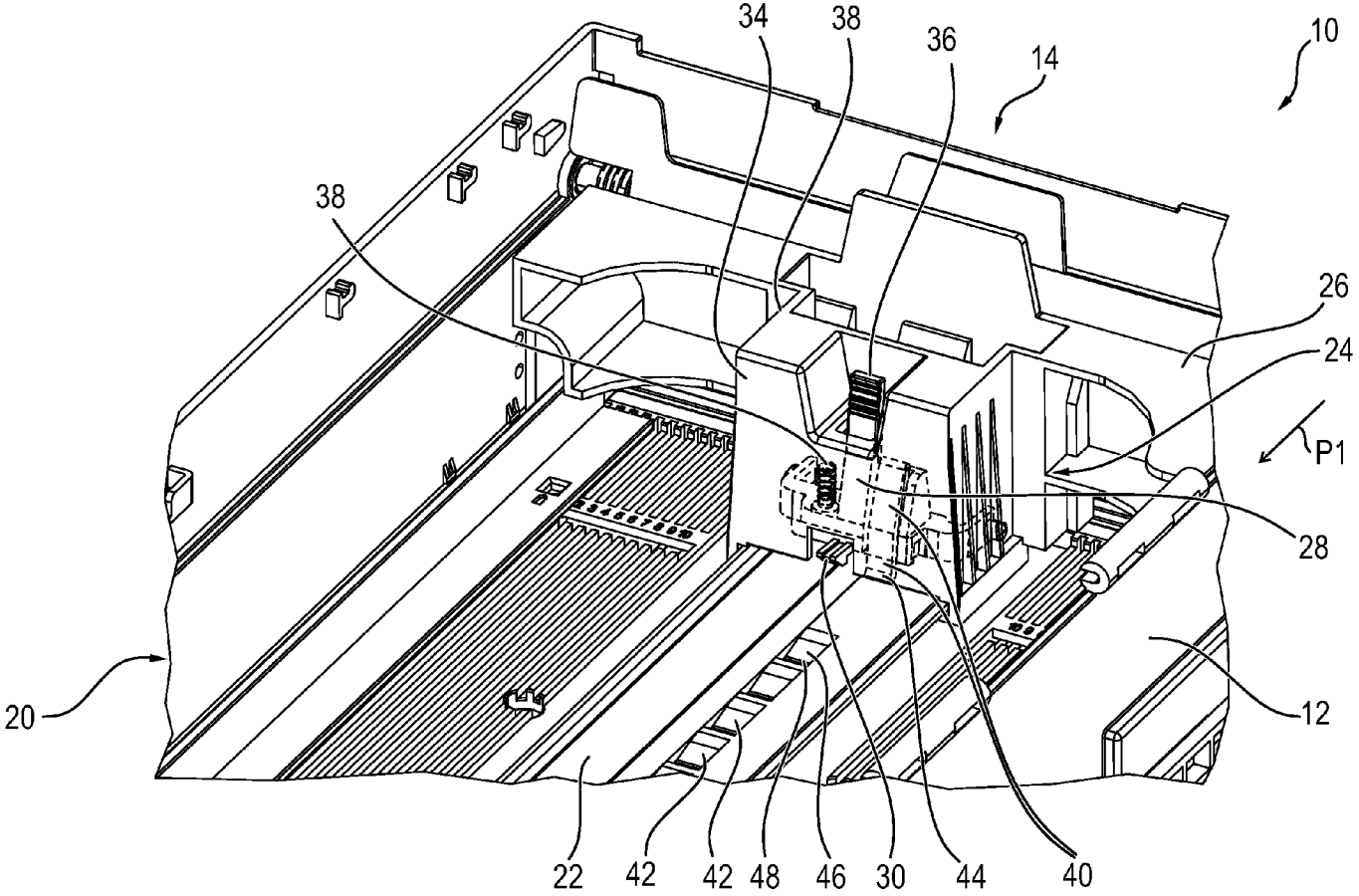
FIG. 2 shows a section of the cash cassette according to FIG. 1.

In FIG. 2, a schematic perspective illustration of a section of the cash cassette 10 according to FIG. 1 is shown. Here, the cover 18 is omitted to allow for a better view of the inner components of the cash cassette 10.

The cash cassette 10 has a compartment 20 in which notes of value can be received as a value note stack, these notes of value standing with their edges on a bottom unit 22 that limits the receiving compartment 20 in the direction of the cassette bottom 13.

Within the receiving compartment, a press-on unit 24 is arranged that is movable in the direction of deposit P1 and opposite to the direction of deposit P1. The direction of deposit P1 is the feeding direction of the notes of value, when these are fed into the receiving compartment through the first opening 14.

The press-on unit 24 serves to exert a counterforce on the received value note stack so that this stack is reliably received in the section of the receiving compartment 20 between the press-on unit 24 and the first opening 14. In particular, the press-on unit 24 serves to hold the notes of value as a compact value note stack at all times so that they cannot turn over and so that a safe automatic feeding and/or removing is possible at all times. For this, the press-on unit 24 comprises a contact unit 26 which contacts the note of value arranged at the front end of the value note stack.

Figure 3:
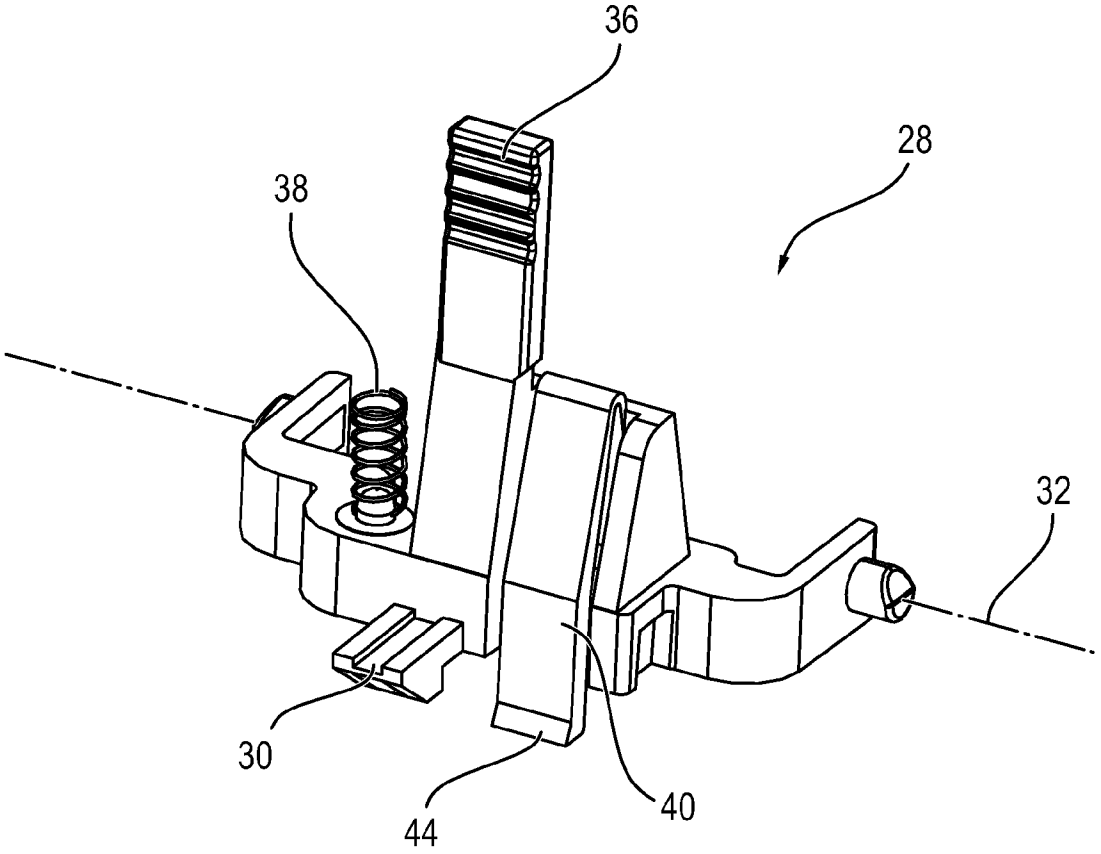
FIG. 3 shows a schematic perspective illustration of a locking element of a press-on unit of the cash cassette according to FIGS. 1 and 2.

The press-on unit 24 comprises a locking element 28 which is illustrated in FIG. 3. The locking element 28 has an engagement element 30 via which the press-on unit 24 can be held in an end position when it is engaged with a complementary further engagement element of the bottom unit 22. This end position is in particular the position in which the press-on unit 24 is arranged at the side of the receiving compartment that is opposite to the first opening 14. The press-on unit 24 is in particular arranged in this end position when a manual feeding and/or removing of notes of value via the second opening 18 is to take place. For locking and unlocking, the locking element 28 is movable between a locking position and an unlocked position, for which it is rotatably mounted about an axis of rotation 32 in a housing 34 of the press-on unit 24. Via a lever 36, the locking element 28 can be manually moved from the locking position into an unlocked position against a restoring force applied by a spring 38. The locking element 28 has a second snap-in element 40 that is formed complementarily to first snap-in elements 42 of the bottom unit 22. In the bottom unit 22, in particular a plurality of first snap-in elements 42 is provided, which are formed one behind the other as viewed in the direction of deposit P1 and which are in particular identically formed. In the embodiment shown in FIG. 2, these first snap-in elements are formed as recesses into which the second snap-in element 40 can engage to thus establish a snap-fit connection between the first and the second snap-in element 40, 42, via which a connection is established between the bottom unit 22 and the press-on unit 24 so that the counterforce required for holding the value note stack can be applied.

When notes of value are fed, the press-on unit 24 is moved increasingly further from the position shown in FIG. 2 into the direction of deposit P1 until the second snap-in element 40 arrives behind the area of the first snap-in element 42 that is arranged furthest ahead and engages with said first snap-in element 42 via a foot portion 44. As the recess 42 has a longitudinal form, with a slightly sloping area 46 and a steep edge 48, it is achieved that the second snap-in element 40 can at first slide for a predetermined distance within the first snap-in element 42 before then the contact between the edge 48 and the snap-in element 40 is formed so that the snap-fit connection is completely established.

Figure 4:
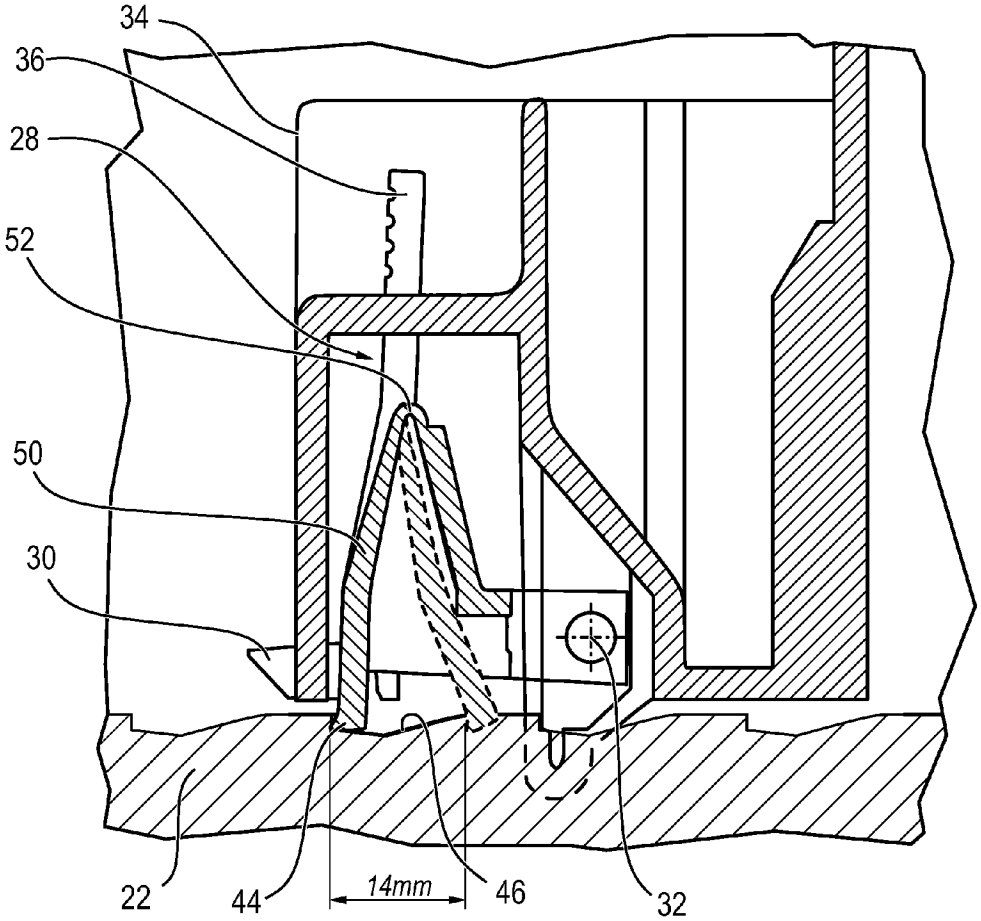
FIG. 4 shows a schematic illustration of a section of the cash cassette according to FIGS. 1 and 2.

The second snap-in element 40 is designed such that it is elastically deformable so that, even in the case of a completely established snap-fit connection between the first and the second snap-in element 40, 42, it still allows that the press-on unit 24 is moved further in the direction of deposit P1 by a predetermined distance. Here, the second snap-in element 40, as illustrated in FIG. 4, is deformed from a first position into a second position. Here, the first position is illustrated by the solid line, the second position is illustrated by the broken line.

The elastic deformability of the second snap-in element 40 is in particular achieved in that it has a stiff portion 50 and a flexible portion 52, the flexible portion 52 allowing the movement of the stiff portion 50 relative to the locking element 28 and is preferably designed as a film hinge.

In an alternative embodiment of the invention, also any other form of an elastic element can be used to give the second snap-in element 40 its elastic deformability. For example, the stiff portion 50 can also be connected to the locking element 28 via a spring or another elastic element.

Alternatively, the second snap-in element 40 may not be mounted on the locking element 28 but at any other element of the press-on unit 24.

Providing the second snap-in element 40 on the locking element 28 has the advantage that via the spring-mount of the locking element 28, the second snap-in element 40 can likewise move so that it can perform the necessary movements when sliding over the first snap-in elements 42.

The distance by which the press-on unit 24 can move from the first contact between the first snap-in element 42 and the second snap-in element 40 up to the final stop is in particular smaller than the height of the smallest note of value to be handled and is about 14 mm so that a turning over of notes of value is safely prevented.

The snap-fit connection between the first and the second snap-in element 40, 42 is in particular formed such that when a minimum force is exceeded, this snap-fit connection is released so that, when the press-on unit 24 is moved further in the direction of deposit, the second snap-in element 40 can engage with the next first snap-in element 42 as viewed in the direction of deposit so that the position of the press-on unit can be adapted to the amount of received notes of value.

Figure 5:
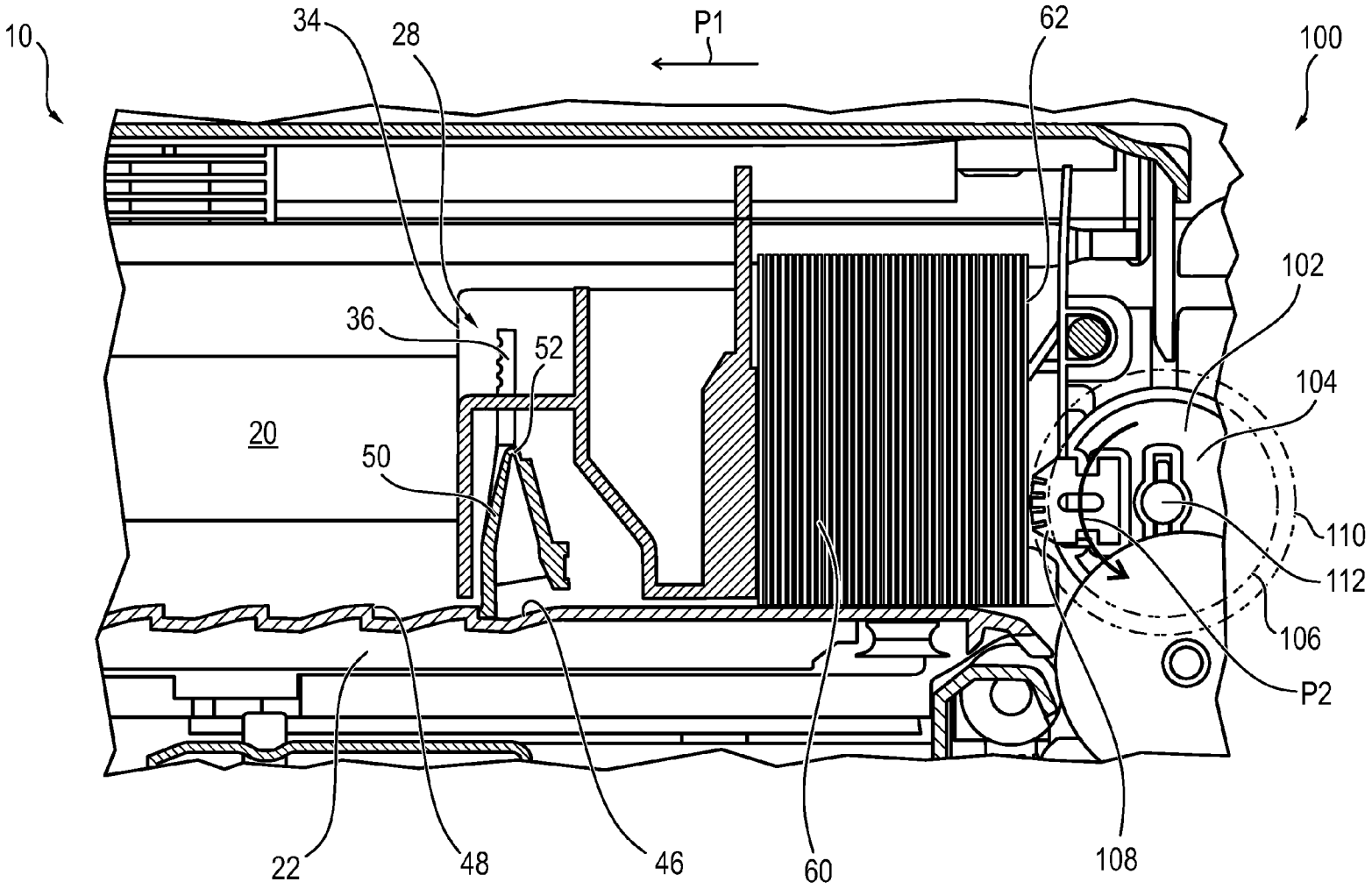
FIG. 5 shows a schematic illustration of the cash cassette according to FIGS. 1 to 4 and of a pull-off module.

In FIG. 5, a schematic illustration of a section of the cash cassette 10 as well as of a pull-off module 100 for removing notes of value from the cash cassette 10 is illustrated. This pull-off module 100 comprises a pull-off roll 102 for removing notes of value from the value note stack 60.

The pull-off roll 102 has a basic body 104 with a first diameter 106 as well as a projecting segment 108. Due to this projecting segment 108, there results a second diameter 110 that is larger than the first diameter 106. The pull-off roll 102 is rotated in the direction of the arrow P2 for pulling-off the note of value 62 arranged at the front end of the value note stack 60. As soon as the projecting segment comes into contact with the note of value, the distance between the axis of rotation 112 and the note of value 62 arranged at the front end increases accordingly from the first diameter 106 to the second diameter 110, for which the value note stack 60 has to be moved further in the direction of deposit P1 into the receiving compartment 20 by the corresponding distance between the first and the second diameter 106, 110. The elastic deformability of the second snap-in element 40 makes it possible that this movement of the value note stack 60 is possible despite the existing snap-fit connection between the first and the second snap-in element 40, 42 so that the note of value 62 can be pulled-off reliably. In particular, it is prevented in this way that jams might occur or that the pull-off module even goes out of service because it cannot perform the desired rotation of the pull-off roll 102.

Figure 6:
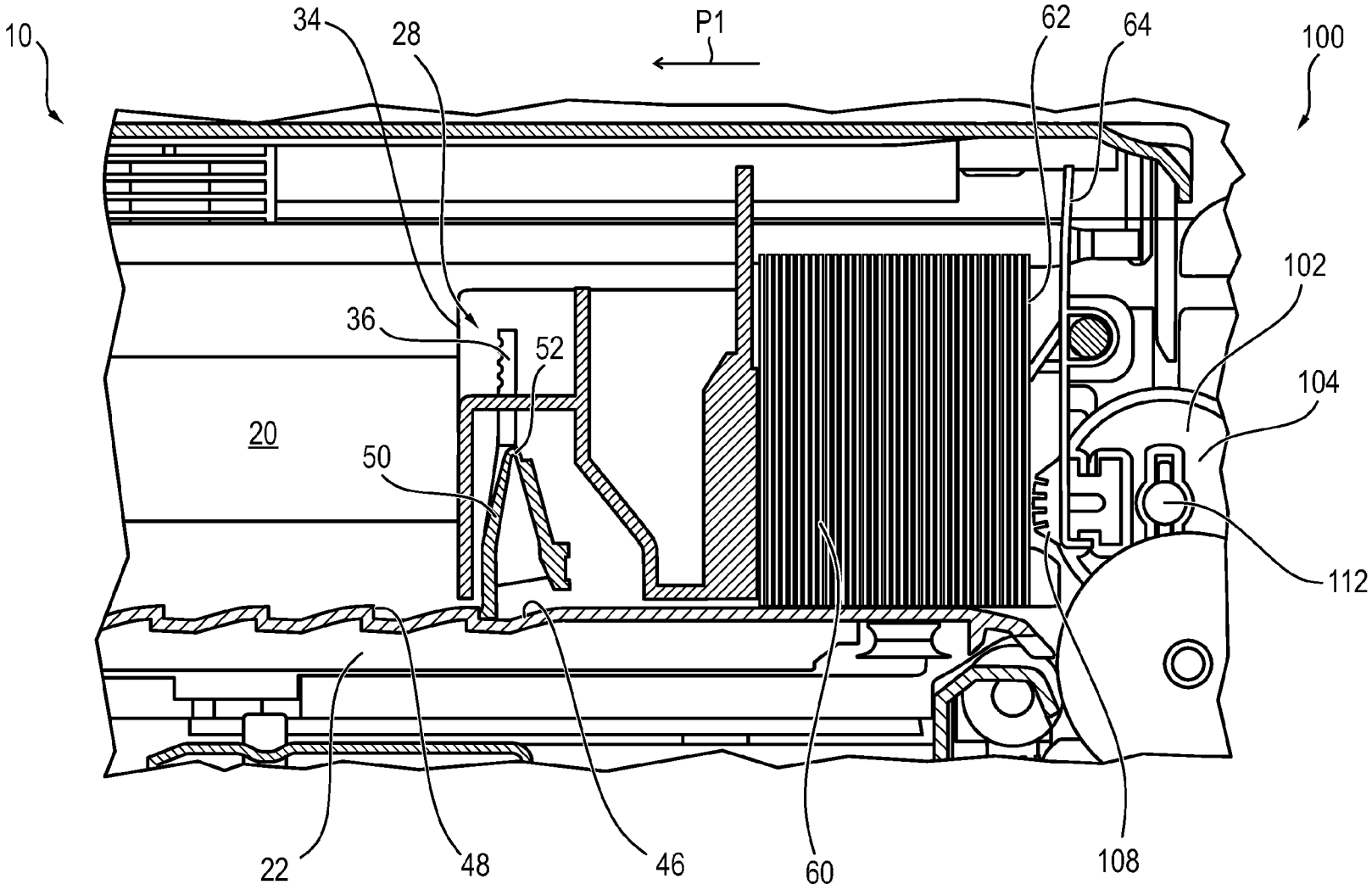
FIG. 6 shows a schematic illustration of the cash cassette and of the pull-off module according to FIG. 5 in a first operating state.

In FIG. 6, a further schematic illustration of a section of the cash cassette 10 as well as of a section of the pull-off module 100 is shown. Here, the operating state is shown, in which notes of value 62 of the value note stack 60 can be removed. For this, a retaining element 64 of the cash cassette 10 is arranged in an open position in which it does not contact the value note stack 60 and enables a pull-off of the notes of value 62.

Figure 7:
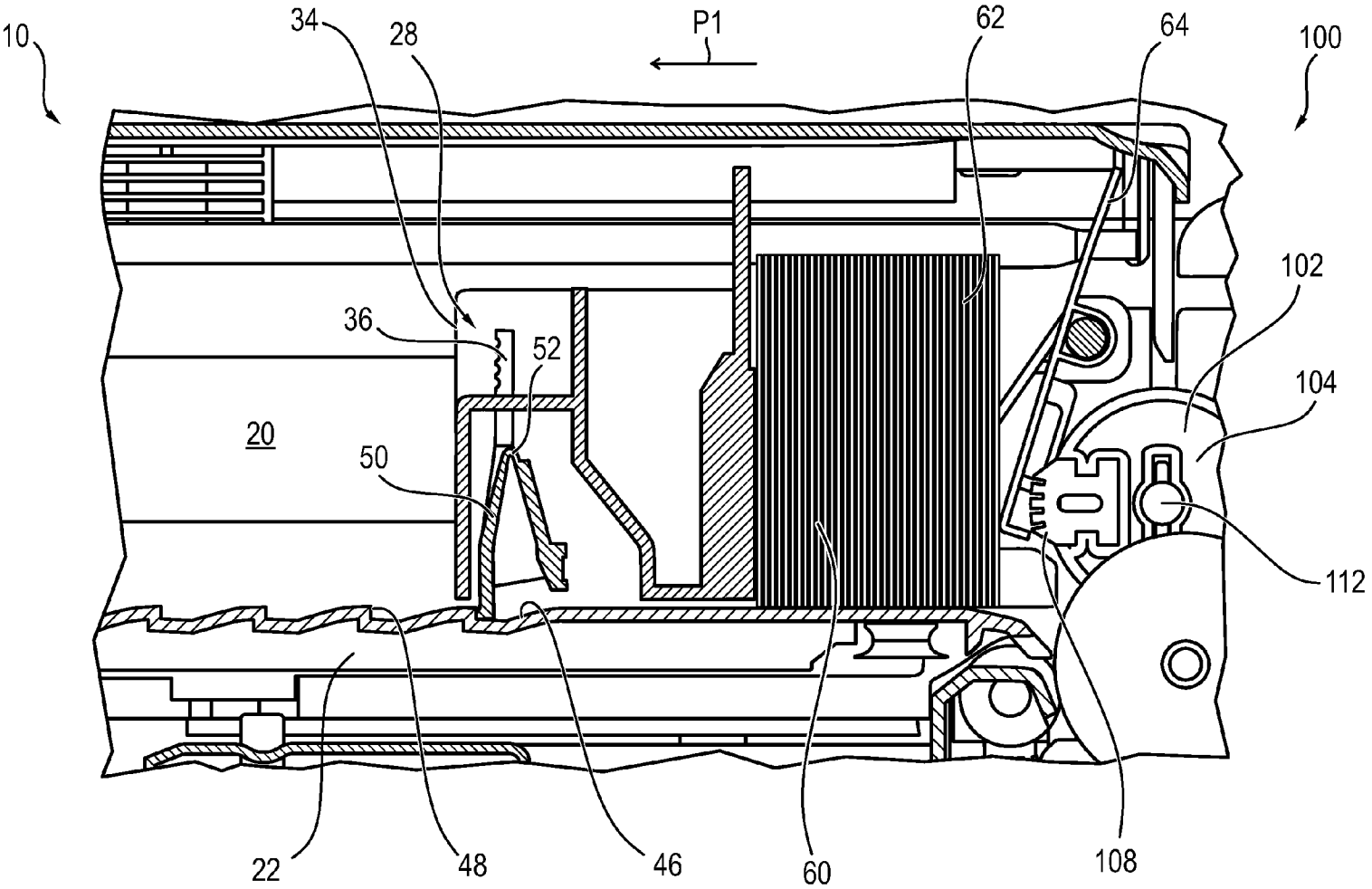
FIG. 7 shows a schematic illustration of the cash cassette and of the pull-off module according to FIG. 5 in a second operating state.

In FIG. 7, a schematic illustration of a section of the cash cassette 10 as well as of a section of the pull-off module 100 is shown in a further operating state, in which notes of value 62 can no longer be removed via the pull-off module 100 and which is used in particular when the cash cassette 10 is removed from a device for handling notes of value and the first opening 14 is closed by a closing element. In this operating state, the retaining element 64 is pivoted toward the receiving compartment 20 so that it is arranged in a retaining position in which it contacts the note of value 62 arranged at the front end of the value note stack 60. Thus, the value note stack 60 is clamped between the press-on unit 24 and the retaining element 64 so that it is safely received in the receiving compartment 20 when handling the cash cassette.

Figure 8:
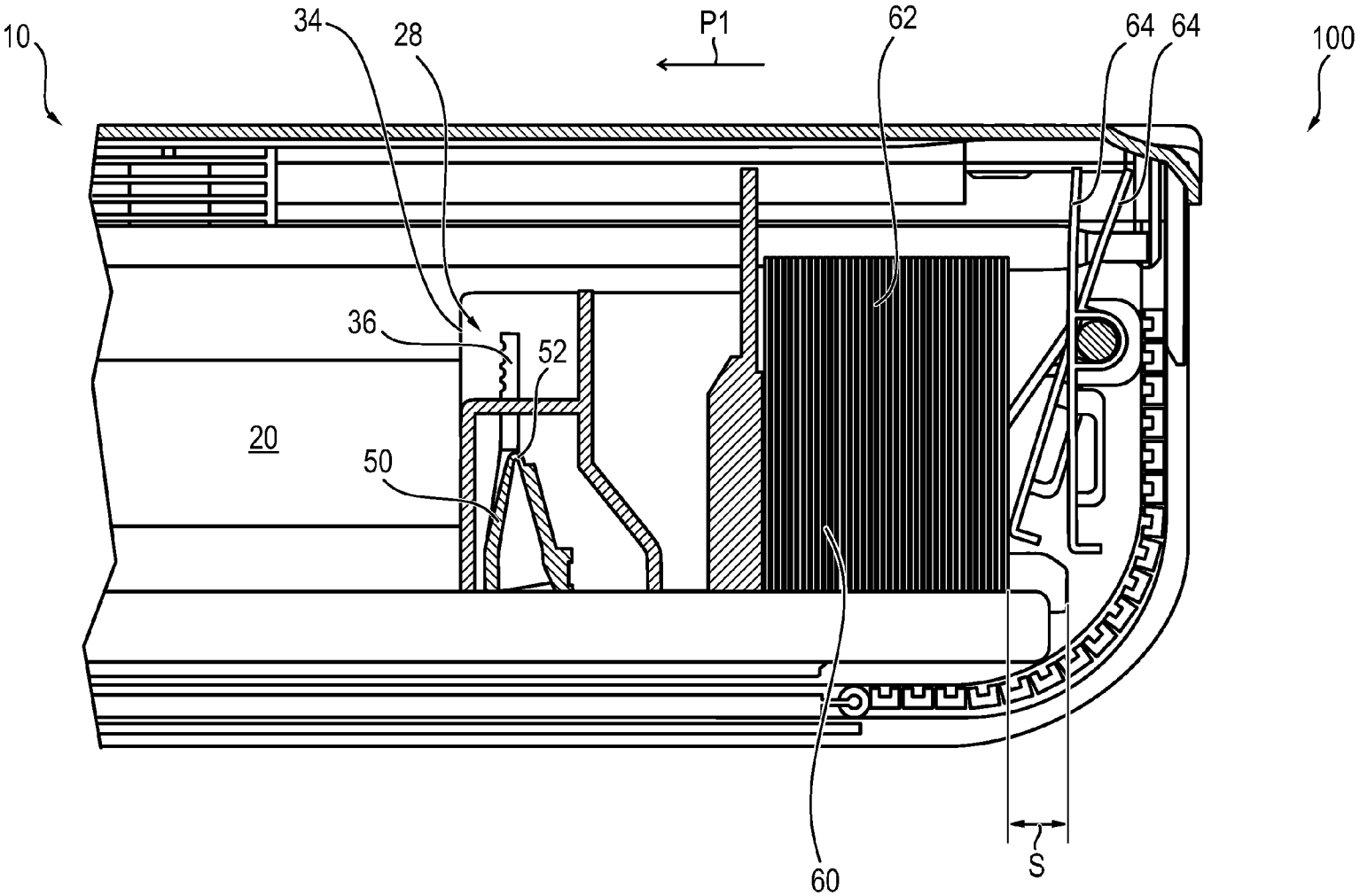
FIG. 8 shows a schematic illustration of the cash cassette according to FIGS. 6 and 7, in which the two operating states are illustrated in a superimposed manner.

In FIG. 8, a section of the cash cassette 10 is shown, the two operating states shown in FIGS. 6 and 7 being illustrated in a superimposed manner in that the retaining element 64 is illustrated in both positions. As can be taken well from FIG. 8, when the retaining element is moved from the open into the retaining position, the value note stack 60 has to be moved further into the receiving compartment 20 in the direction of deposit P1 by a distance S. As a result of the elastic deformability of the second snap-in element 40, it is achieved that the movement by the distance S is possible even if the snap-fit connection between the first and the second snap-in element 40, 42 is established so that a movement of the retaining element 64 from the open into the closed position is safely and reliably possible at all times when the cash cassette is removed.

What is claimed is:

1. A cash cassette, comprising a receiving compartment for receiving a value note stack;

a bottom unit which limits the receiving compartment in one direction; and a press-on unit for exerting a counterforce directed opposite to the direction of deposit of notes of value on the value note stack received in the receiving compartment;

the press-on unit being movable in the direction of deposit and opposite to the direction of deposit;

wherein the bottom unit includes at least a first snap-in element having a sloping portion and a steep edge extending generally vertically relative to the bottom unit;

wherein the press-on unit has a second snap-in element that is complementarily formed to the first snap-in element the second snap-in element including an elastically deformable hinge, a stiff portion extending from the elastically deformable hinge, and a foot portion at a distal end of the stiff portion, the stiff portion is stiff as compared to the elastically deformable hinge;

wherein via the first and the second snap-in element a snap-fit connection between the bottom unit and the press-on unit for exerting the counterforce on the value note stack can be established where the foot portion abuts the steep edge; and when the foot portion is received within the first snap-in element such that the foot portion abuts against the steep edge, the elastically deformable hinge permits the press-on unit to slidably shift a predetermined distance in the deposit direction to facilitate removal of notes of value from the value note stack by a protecting segment of a pull-off roll, the protecting segment protrudes outward from the pull-off roll and upon contacting the value note stack pushes the value note stack and the press-on unit in the deposit direction to cause the elastically deformable hinge to bend when the foot portion abuts the steep edge.

2. The cash cassette according to claim 1, wherein several first snap-in elements arranged one behind the other as viewed in the direction of deposit are provided in the bottom unit.

3. The cash cassette according to claim 2, wherein the first snap-in elements are identically formed.

4. The cash cassette according to claim 1, wherein the first snap-in element is formed as a recess in the bottom unit.

5. The cash cassette according to claim 1, wherein the press-on unit comprises a locking element for holding the press-on unit in an end position, that the locking element, in a locking position, is engaged with a stationary first engagement element of the cash cassette and, in an unlocked position, allows a movement of the press-on unit opposite to the direction of deposit, and that the second snap-in element is formed as a part of this locking element.

6. The cash cassette according to claim 5, wherein the locking element is mounted on the press-on unit so as to be pivotable about an axis of rotation, and that the locking element is pivoted about the axis of rotation when it is moved between the locking position and the unlocked position.

7. The cash cassette according to claim 5, wherein the locking element is held in the locking position by an elastic element, in particular a spring, and is movable manually from the locking position into the unlocked position against a restoring force of the elastic element.

8. The cash cassette according to claim 5, wherein the locking element comprises a lever for manual actuation.

9. The cash cassette according to claim 1, wherein the second snap-in element is formed elastically such that it is movable between a first and a second position against a restoring force of the second snap-in element.

10. The cash cassette according to claim 1, wherein the predetermined distance is smaller than the height of the smallest note of value to be received in the receiving compartment.

11. The cash cassette according to claim 1, wherein the first snap-in element is designed such that the second snap-in element, after the contact between the first and the second snap-in element has been established, can still move in the direction of deposit by a predetermined distance within the first snap-in element before the snap-fit connection is finally established.

12. The cash cassette according to claim 11, wherein the second snap-in element has a foot portion for bearing against and sliding on the first snap-in element.

13. The cash cassette according to claim 11, wherein between the establishment of the contact between the first and the second snap-in element and the final stop of the movement in the direction of deposit as a result of the snap-fit connection, the press-on unit is movable by a distance between 10 mm and 16 mm in the direction of deposit due to the movement of the second snap-in element within the first snap-in element and the elastic deformation of the second snap-in element.

14. A cash cassette comprising:

a receiving compartment configured to receive a stack of notes of value, the notes of value deposited into the receiving compartment along a deposit direction;

a plurality of recesses defined at a bottom surface of the receiving compartment the recesses each including a sloping portion and a steep edge extending generally vertically relative to the bottom surface;

a press-on unit slidably movable along the bottom surface in the deposit direction, and slidably movable in a direction opposite to the deposit direction to exert a counterforce against the stack; and a snap-in element of the press-on unit including an elastically deformable hinge, a stiff portion extending from the elastically deformable hinge, and a foot portion at a distal end of the stiff portion, the foot portion is configured to be received by any one of the plurality of recesses;

wherein:

the stiff portion is stiff as compared to the elastically deformable hinge;

when the foot portion is received within any one of the plurality of recesses such that the foot portion abuts against the steep edge, the elastically deformable hinge permits the press-on unit to slidably shift a predetermined distance in the deposit direction to facilitate removal of notes of value from the stack by a protecting segment of a pull-off roll, the protecting segment protrudes outward from the pull-off roll and upon contacting the stack of notes pushes the stack of notes and the press-on unit in the deposit direction to cause the elastically deformable hinge to bend when the foot portion abuts the steep edge.

* * * * *